US010667554B2

(12) United States Patent
Phillips et al.

(10) Patent No.: US 10,667,554 B2
(45) Date of Patent: Jun. 2, 2020

(54) SMOKING ARTICLES

(71) Applicant: RAI Strategic Holdings, Inc., Winston-Salem, NC (US)

(72) Inventors: Percy D. Phillips, Pfafftown, NC (US); Michael F. Davis, Clemmons, NC (US); Karen V. Taluskie, Winston-Salem, NC (US); Stephen Benson Sears, Siler City, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 242 days.

(21) Appl. No.: 15/707,461

(22) Filed: Sep. 18, 2017

(65) Prior Publication Data

US 2019/0082735 A1 Mar. 21, 2019

(51) Int. Cl.
*A24F 47/00* (2020.01)
*A24B 15/16* (2020.01)
(Continued)

(52) U.S. Cl.
CPC ..... *A24F 47/004* (2013.01); *A24B 15/165* (2013.01); *A24F 7/04* (2013.01);
(Continued)

(58) Field of Classification Search
CPC ..... A24F 47/004
See application file for complete search history.

(56) References Cited

U.S. PATENT DOCUMENTS 3,419,015 A 12/1968 Wochnowski
4,054,145 A 10/1977 Berndt et al.
(Continued)

FOREIGN PATENT DOCUMENTS

WO WO 94/27452 12/1994
WO WO 98/57556 12/1998
(Continued)

OTHER PUBLICATIONS

Chemical and Biological Studies on New Cigarette Prototypes that Heat Instead of Burn Tobacco, RJRTC Monograph, 1988.
(Continued)

*Primary Examiner* — James Harvey
(74) *Attorney, Agent, or Firm* — Womble Bond Dickinson (US) LLP

(57) ABSTRACT

Smoking articles are disclosed herein. In one aspect, a smoking article includes a heat source configured to generate heat upon ignition thereof, a first substrate material having an aerosol precursor composition associated therewith and a first end being fixedly engaged with the heat source, and an aerosol delivery component having opposed first and second ends, the first end of the aerosol delivery component being engaged with the second end of the first substrate material. In some aspects, the aerosol delivery component includes a second substrate material having the aerosol precursor composition associated therewith and being disposed about the first end of the aerosol delivery component and a tobacco material disposed between the second substrate material and the mouthpiece, the aerosol precursor composition associated with the first and second substrate materials being configured to produce an aerosol in response to the heat generated by the ignited heat source.

9 Claims, 5 Drawing Sheets

FIG. 1A

(51) Int. Cl.
*A24F 7/04* (2006.01)
*A24D 1/00* (2020.01)

(52) U.S. Cl.
CPC ..... *A24F 47/002* (2013.01); *A24F 47/006* (2013.01); *A24F 47/008* (2013.01); *A24D 1/008* (2013.01)

(56) References Cited

U.S. PATENT DOCUMENTS 4,449,541 A 5/1984 Mays et al.
4,714,082 A 12/1987 Banerjee et al.
4,735,217 A 4/1988 Gerth et al.
4,793,365 A 12/1988 Sensabaugh, Jr. et al.
4,807,809 A 2/1989 Pryor et al.
4,830,028 A 5/1989 Lawson et al.
4,836,224 A 6/1989 Lawson et al.
4,887,619 A 12/1989 Burcham, Jr. et al.
4,889,143 A 12/1989 Pryor et al.
4,922,901 A 5/1990 Brooks et al.
4,924,888 A 5/1990 Perfetti et al.
4,947,874 A 8/1990 Brooks et al.
4,947,875 A 8/1990 Brooks et al.
4,991,606 A * 2/1991 Serrano ..... A24B 15/165 131/194
5,022,416 A 6/1991 Watson
5,025,814 A 6/1991 Raker
5,050,621 A * 9/1991 Creighton ..... A24B 15/165 131/194
5,056,537 A 10/1991 Brown et al.
5,060,671 A 10/1991 Counts et al.
5,060,676 A 10/1991 Hearn et al.
5,067,499 A * 11/1991 Banerjee ..... A24D 1/18 131/194
5,093,894 A 3/1992 Deevi et al.
5,101,839 A 4/1992 Jakob et al.
5,103,842 A 4/1992 Strang et al.
5,105,831 A 4/1992 Banerjee et al.
5,159,940 A * 11/1992 Hayward ..... A24B 15/165 131/194
5,159,942 A 11/1992 Brinkley et al.
5,220,930 A 6/1993 Gentry
5,224,498 A 7/1993 Deevi et al.
5,228,460 A 7/1993 Sprinkel et al.
5,249,586 A 10/1993 Morgan et al.
5,261,424 A 11/1993 Sprinkel, Jr.
5,322,075 A 7/1994 Deevi et al.
5,345,951 A * 9/1994 Serrano ..... A24B 15/165 131/194
5,353,813 A 10/1994 Deevi et al.
5,360,023 A 11/1994 Blakley et al.
5,372,148 A 12/1994 McCafferty et al.
5,468,936 A 11/1995 Deevi et al.
5,498,850 A 3/1996 Das
5,498,855 A 3/1996 Deevi et al.
5,530,225 A 6/1996 Hajaligol
5,551,451 A 9/1996 Riggs et al.
5,573,692 A 11/1996 Das et al.
5,591,368 A 1/1997 Fleischhauer et al.
5,659,656 A 8/1997 Das
5,665,262 A 9/1997 Hajaligol et al.
5,666,977 A 9/1997 Higgins et al.
5,711,320 A 1/1998 Martin
5,934,289 A 8/1999 Watkins et al.
5,954,979 A 9/1999 Counts et al.
5,967,148 A 10/1999 Harris et al.
6,040,560 A 3/2000 Fleischhauer et al.
6,053,176 A 4/2000 Adams et al.
6,164,287 A 12/2000 White
6,196,218 B1 3/2001 Voges
6,701,936 B2 3/2004 Shafer et al.
6,730,832 B1 5/2004 Dominguez et al.
6,772,756 B2 8/2004 Shayan
6,803,545 B2 10/2004 Blake et al.
6,810,883 B2 11/2004 Felter et al.
6,854,461 B2 2/2005 Nichols et al.
7,011,096 B2 3/2006 Li et al.
7,017,585 B2 3/2006 Li et al.
7,025,066 B2 4/2006 Lawson et al.
7,040,314 B2 5/2006 Nguyen et al.
7,290,549 B2 11/2007 Banerjee et al.
7,293,565 B2 11/2007 Griffin et al.
7,513,253 B2 4/2009 Kobayashi et al.
7,615,184 B2 11/2009 Lobovsky et al.
7,647,932 B2 1/2010 Cantrell et al.
7,726,320 B2 6/2010 Robinson et al.
7,832,410 B2 11/2010 Hon
7,836,897 B2 11/2010 Borschke et al.
7,896,006 B2 3/2011 Hamano et al.
8,079,371 B2 12/2011 Robinson et al.
8,156,944 B2 4/2012 Han
8,186,360 B2 5/2012 Marshall et al.
8,375,957 B2 2/2013 Hon
8,402,976 B2 3/2013 Fernando et al.
8,689,804 B2 4/2014 Fernando et al.
8,794,231 B2 8/2014 Thorens et al.
8,851,083 B2 10/2014 Oglesby et al.
8,915,254 B2 12/2014 Monsees et al.
8,925,555 B2 1/2015 Monsees et al.
9,107,453 B2 8/2015 Dube et al.
2004/0255965 A1 12/2004 Perfetti et al.
2006/0196518 A1 9/2006 Hon
2007/0215167 A1 9/2007 Llewellyn Crooks et al.
2007/0215168 A1 9/2007 Banerjee et al.
2009/0044818 A1 2/2009 Takeuchi et al.
2009/0188490 A1 7/2009 Han
2010/0024834 A1 2/2010 Oglesby et al.
2010/0125039 A1* 5/2010 Banerjee ..... C01B 32/354 502/417
2010/0307518 A1 12/2010 Wang
2011/0041861 A1* 2/2011 Sebastian ..... A24F 47/004 131/365
2012/0042885 A1 2/2012 Stone et al.
2012/0152265 A1 6/2012 Dube et al.
2013/0008457 A1 1/2013 Zheng et al.
2013/0255702 A1 10/2013 Griffith, Jr. et al.
2013/0269720 A1* 10/2013 Stone ..... A24C 5/603 131/328
2014/0096781 A1 4/2014 Sears et al.
2014/0373859 A1* 12/2014 Raether ..... A24B 15/165 131/329
2015/0157052 A1 6/2015 Ademe et al.
2015/0216232 A1 8/2015 Bless et al.
2015/0245659 A1 9/2015 DePiano et al.
2015/0335070 A1 11/2015 Sears et al.
2015/0344456 A1 12/2015 Dull et al.
2016/0360785 A1 12/2016 Bless et al.
2018/0243520 A1* 8/2018 Johnson ..... A61M 15/06
2019/0000144 A1* 1/2019 Bless ..... G06K 7/10366
2019/0082735 A1* 3/2019 Phillips ..... A24F 7/04

FOREIGN PATENT DOCUMENTS

WO WO 02/37990 5/2002
WO WO 2010/091593 8/2010
WO WO 2013/043299 3/2013
WO WO 2013/120855 8/2013

OTHER PUBLICATIONS

Bombick et al., "Evaluation of the Genotoxic and Cytotoxic Potential of Mainstream Whole Smoke and Smoke Condensate from a Cigarette Containing a Novel Carbon Filter," Fundamental and Applied Toxicology, 1997, vol. 39, pp. 11-17.
Gutcho, "Tobacco Flavoring Substances and Methods," Noyes Data Corp, 1972.
Leffingwell, et al., Tobacco Flavoring for Smoking Products, R.J. Reynolds Tobacco Company, 1972.

* cited by examiner

SMOKING ARTICLES

BACKGROUND

Field of the Disclosure

The present disclosure relates to aerosol delivery devices and systems, such as smoking articles; and more particularly, to aerosol delivery devices and systems that utilize combustible carbon-based ignition sources or electrically-generated heat for the production of aerosol (e.g., smoking articles for purposes of yielding components of tobacco and other materials in an inhalable form, commonly referred to as heat-not-burn systems or electronic cigarettes). Highly preferred components of such articles are made or derived from tobacco, or those articles can be characterized as otherwise incorporating tobacco for human consumption, and which are capable of vaporizing components of tobacco and/or other tobacco related materials to form an inhalable aerosol for human consumption.

Description of Related Art

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and/or pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0220232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety.

Certain tobacco products that have employed electrical energy to produce heat for aerosol formation, and in particular, certain products that have been referred to as electronic cigarette products, have been commercially available throughout the world. Representative products that resemble many of the attributes of traditional types of cigarettes, cigars or pipes have been marketed as ACCORD® by Philip Morris Incorporated; ALPHA™, JOYE 510™ and M4™ by InnoVapor LLC; CIRRUS™ and FLING™ by White Cloud Cigarettes; BLU™ by Lorillard Technologies, Inc.; COHITA™, COLIBRI™, ELITE CLASSIC™, MAGNUM™, PHANTOM™ and SENSE™ by EPUFFER® International Inc.; DUOPRO™, STORM™ and VAPORKING® by Electronic Cigarettes, Inc.; EGAR™ by Egar Australia; eGo-C™ and eGo-T™ by Joyetech; ELUSION™ by Elusion UK Ltd; EONSMOKE® by Eonsmoke LLC; FIN™ by FIN Branding Group, LLC; SMOKE® by Green Smoke Inc. USA; GREENARETTE™ by Greenarette LLC; HALLIGAN™, HENDU™, JET™, MAXXQ™, PINK™ and PITBULL™ by SMOKE STIK®; HEATBAR™ by Philip Morris International, Inc.; HYDRO IMPERIAL™ and LXE™ from Crown7; LOGIC™ and THE CUBAN™ by LOGIC Technology; LUCI® by Luciano Smokes Inc.; METRO® by Nicotek, LLC; NJOY® and ONEJOY™ by Sottera, Inc.; NO. 7™ by SS Choice LLC; PREMIUM ELECTRONIC CIGARETTE™ by PremiumEstore LLC; RAPP E-MYSTICK™ by Ruyan America, Inc.; RED DRAGON™ by Red Dragon Products, LLC; RUYAN® by Ruyan Group (Holdings) Ltd.; SF® by Smoker Friendly International, LLC; GREEN SMART SMOKER® by The Smart Smoking Electronic Cigarette Company Ltd.; SMOKE ASSIST® by Coastline Products LLC; SMOKING EVERYWHERE® by Smoking Everywhere, Inc.; V2CIGS™ by VMR Products LLC; VAPOR NINE™ by VaporNine LLC; VAPOR4LIFE® by Vapor 4 Life, Inc.; VEPPO™ by E-CigaretteDirect, LLC; VUSE® by R. J. Reynolds Vapor Company; Mistic Menthol product by Mistic Ecigs; and the Vype product by CN Creative Ltd. Yet other electrically powered aerosol delivery devices, and in particular those devices that have been characterized as so-called electronic cigarettes, have been marketed under the tradenames COOLER VISIONS™; DIRECT E-CIG™; DRAGONFLY™; EMIST™; EVERSMOKE™; GAMUCCI®; HYBRID FLAME™; KNIGHT STICKS™; ROYAL BLUES™; SMOKETIP®; SOUTH BEACH SMOKE™.

In some instances, traditional types of smoking articles, such as those referenced above, are difficult to assemble for a consumer as a result of multiple components that must be disassembled and reassembled upon consumption of aerosol delivery components provided therein. In some other instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In still further instances, traditional types of smoking articles can produce relatively significant levels carbon monoxide during use.

As such, it would be desirable to provide smoking articles that solve the technical problems sometimes associated with traditional types of smoking articles. Such smoking articles include but are not limited to bi-component smoking articles, smoking articles that include reloadable cartridges encased by thermal casings, and/or battery driven smoking articles.

BRIEF SUMMARY OF THE DISCLOSURE

Smoking articles are disclosed herein. In one aspect, a smoking article comprises a heat source configured to generate heat upon ignition thereof; a first substrate material having opposed first and second ends, the first end of the first substrate material being fixedly engaged with the heat source and the first substrate material having an aerosol precursor composition associated therewith; an aerosol delivery component having opposed first and second ends, the first end of the aerosol delivery component being engaged with the second end of the first substrate material, the aerosol delivery component comprising: a second substrate material having the aerosol precursor composition associated therewith and being disposed about the first end of the aerosol delivery component; a mouthpiece having a filter material and being disposed about the second end of the aerosol delivery component; and a tobacco material disposed between the second substrate material and the mouthpiece, the aerosol precursor composition associated with the first and second substrate materials being configured to produce an aerosol in response to the heat generated by the ignited heat source, the aerosol being drawn across the tobacco material and through the filter material of the mouthpiece in response to a draw applied to the mouthpiece.

In another aspect, a smoking article comprises an aerosol-producing module comprising: a heat source configured to generate heat upon ignition thereof, an aerosol delivery component having opposed first and second ends, the first end being engaged with the heat source, the aerosol delivery component comprising a tobacco material associated with an aerosol precursor composition and being disposed within a tubular member, the aerosol precursor composition associated with the tobacco material being configured to produce an aerosol in response to the heat generated by the heat source, and a mouthpiece engaged with the second end of the aerosol delivery component, the mouthpiece being configured to receive the aerosol in response to a draw applied to the mouthpiece; and a tubular casing comprised of a thermally-insulating material, the tubular casing being configured to receive at least the heat source and the aerosol delivery component of the aerosol-producing module therein in coaxial relation therewith, the tubular casing being configured to thermally regulate conduction of the heat generated by the ignited heat source therethrough.

In a further aspect, a smoking article comprises a power source having opposed first and second ends defining an axis extending therethrough; a heat source in communication with the second end of the power source and extending along the axis, the heat source being configured to generate heat in response to power received from the power source; a tubular casing having a first end engaged with the second end of the power source and extending axially about the heat source to a second end; a solid tobacco material housed within the tubular casing, the solid tobacco material being configured as a cylindrical tube extending about a circumferential surface of the axially-extending heat source, between the heat source and the tubular casing and the solid tobacco material being configured to produce an aerosol in response to the heat generated by the heat source; and a mouthpiece defined by the second end of the tubular casing, opposite the cylindrical tube of the solid tobacco material from the power source, the mouthpiece being configured to receive the aerosol from the solid tobacco material in response to a draw applied to the mouthpiece.

These and other features, aspects, and advantages of the disclosure will be apparent from a reading of the following detailed description together with the accompanying drawings, which are briefly described below.

BRIEF DESCRIPTION OF THE DRAWINGS

Figure 1A:
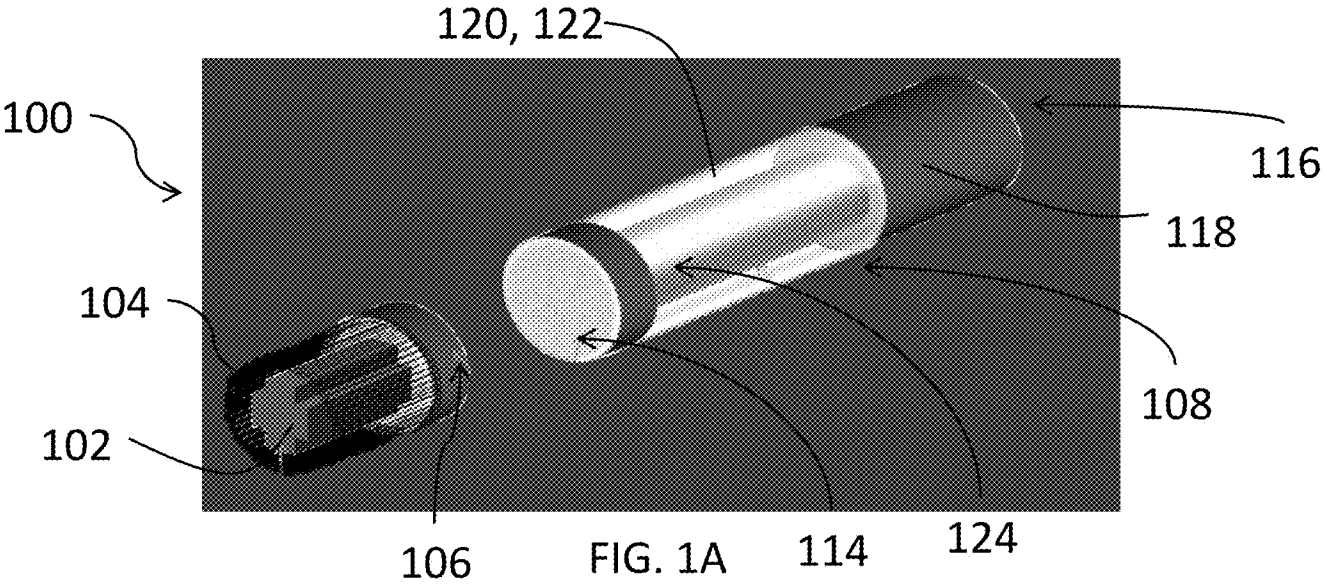
Figure 1B:
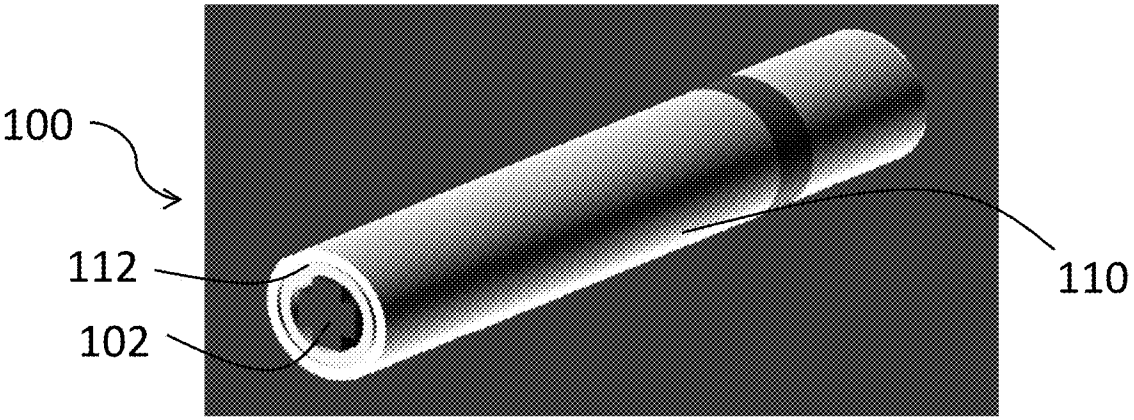
Figure 2A:
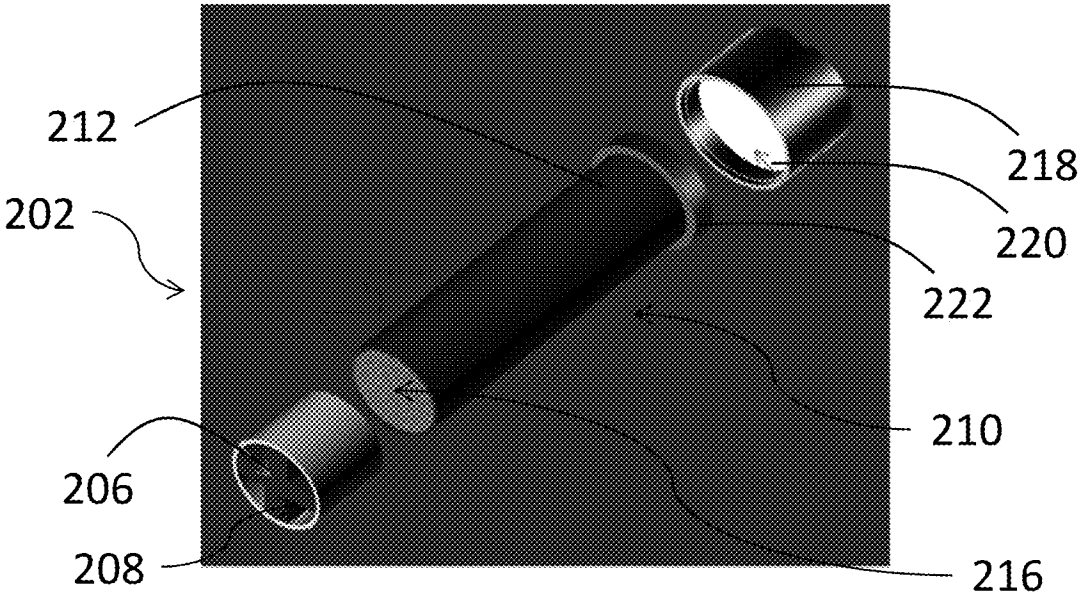
Figure 2B:
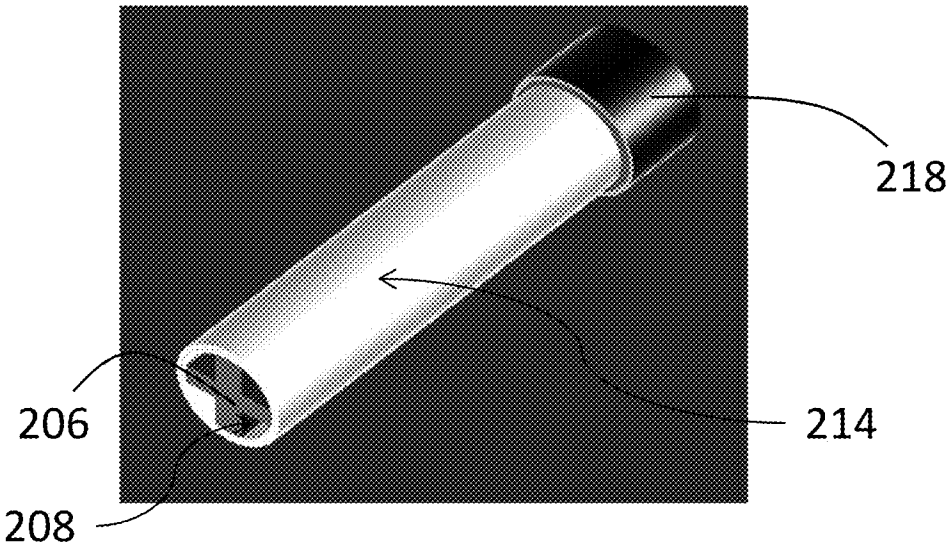
Figure 2C:
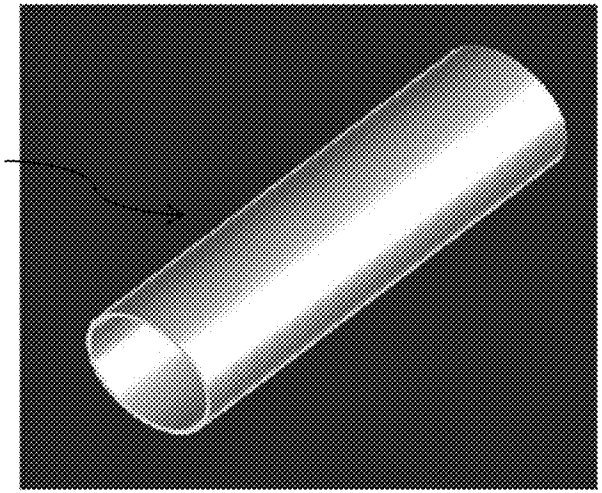
Figure 2D:
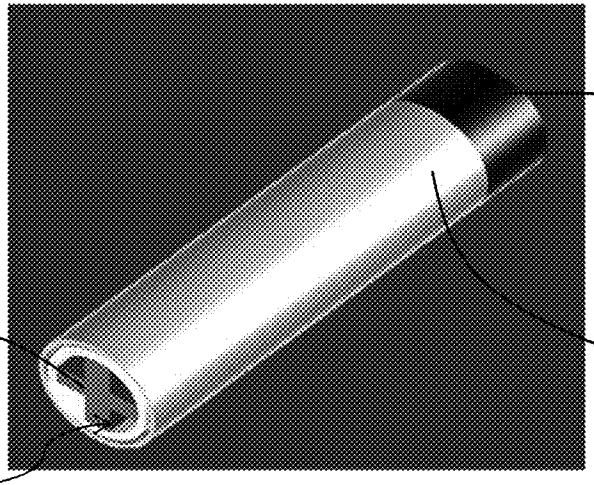
Figure 3A:
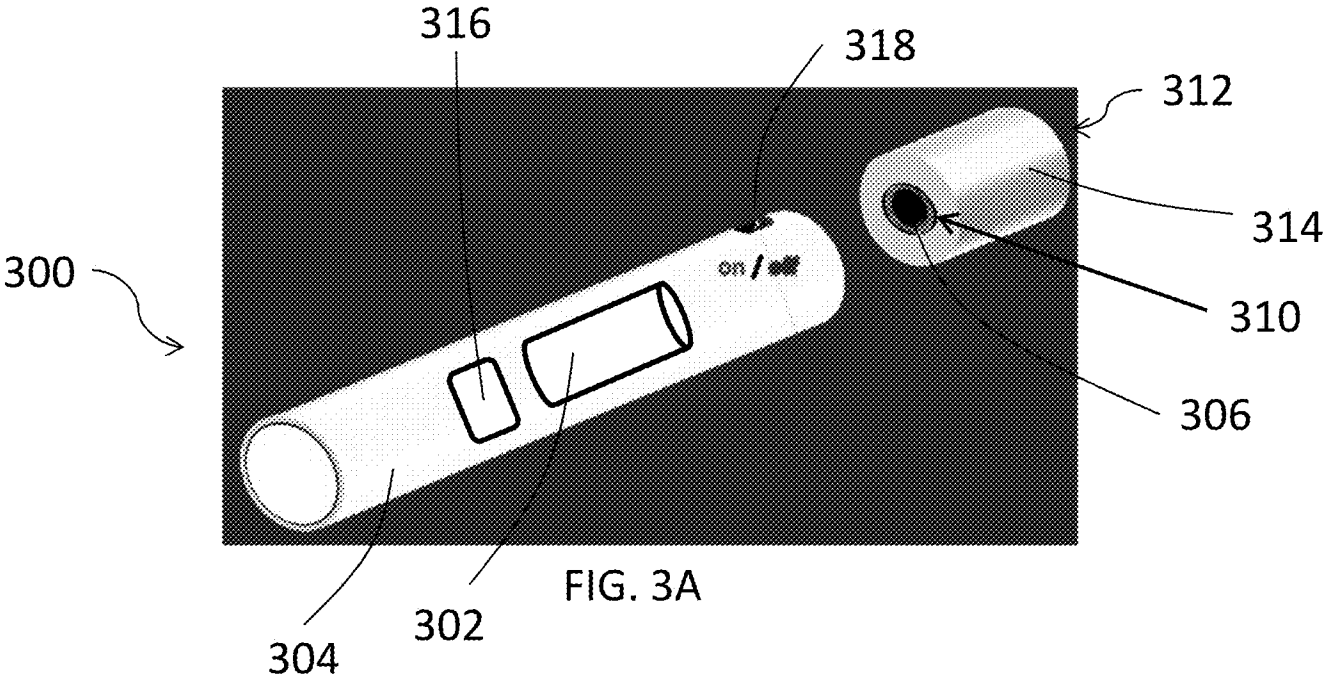
Figure 3B:
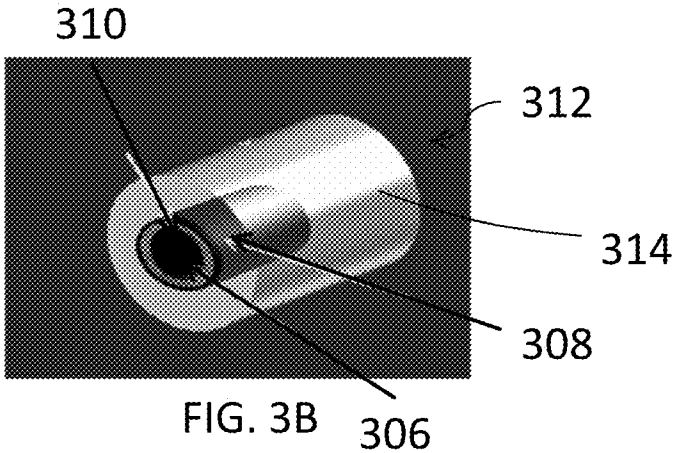
Figure 3C:
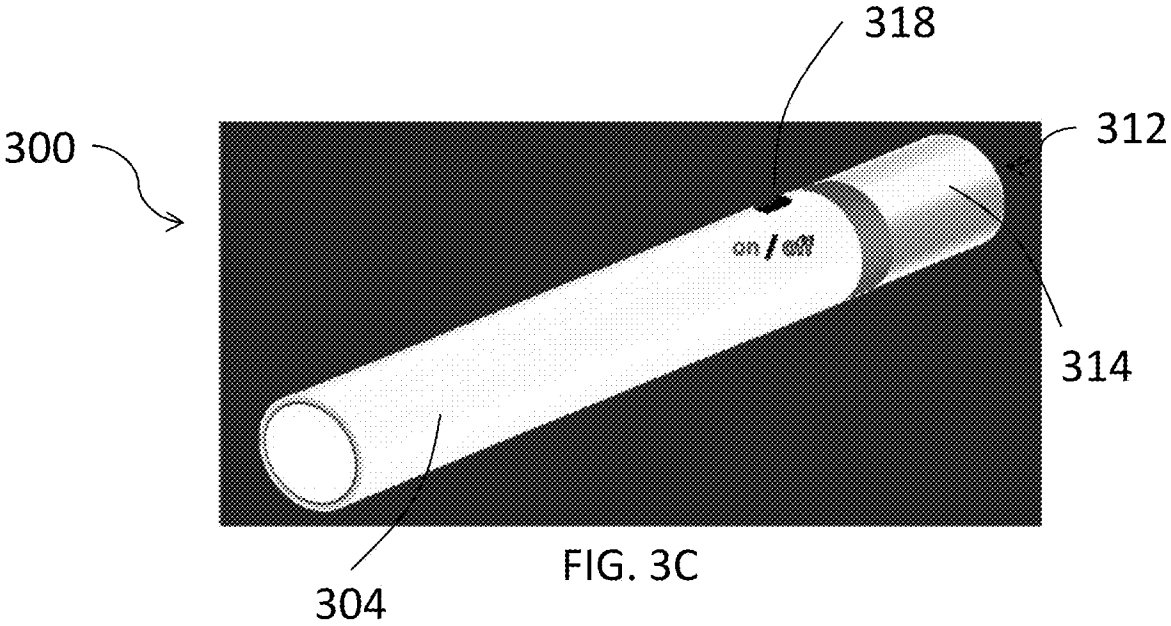

Having thus described the disclosure in the foregoing general terms, reference will now be made to the accompanying drawings, which are not necessarily drawn to scale, and wherein:

FIG. 1A illustrates a perspective view of one aspect of a smoking article including a heat source and an aerosol delivery component in a disassembled configuration according to the present disclosure;

FIG. 1B illustrates the smoking article of FIG. 1A in an assembled configuration via an outer wrap circumscribing the heat source and the aerosol delivery component;

FIG. 2A illustrates a perspective view of another aspect of a smoking article including an aerosol-producing module having a heat source, an aerosol delivery component, and a mouthpiece in a disassembled configuration according to the present disclosure;

FIG. 2B illustrates the aerosol-producing module of FIG. 2A in an assembled configuration via a wrapping material circumscribing at least the heat source and the aerosol delivery component of the aerosol-producing module;

FIG. 2C illustrates an exemplary embodiment of a tubular casing for receiving at least the heat source and the aerosol delivery component of the aerosol-producing module of FIG. 2A;

FIG. 2D illustrates the smoking article of FIG. 2A in an assembled configuration via the tubular casing of FIG. 2C;

FIG. 3A illustrates a perspective view of a further aspect of a smoking article including a power source and a heat source having a solid tobacco material annularly distributed about the heat source and housed in a tubular casing in a disassembled configuration according to the present disclosure;

FIG. 3B illustrates a detailed view of the tubular casing of FIG. 3A; and FIG. 3C illustrates the aerosol-producing module of FIG. 3A in an assembled configuration.

DETAILED DESCRIPTION OF THE DISCLOSURE

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the disclosure is embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present disclosure provides descriptions of articles (and the manufacture thereof) that use electrical energy to heat a material (preferably without combusting the material to any significant degree) to form an aerosol and/or an inhalable substance; such articles most preferably being sufficiently compact to be considered "hand-held" devices. In certain highly preferred aspects, the articles are characterized as smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article and/or device. As used herein, the term "smoking article" does not necessarily mean that, in operation, the article or device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In highly preferred aspects, articles or devices characterized as smoking articles incorporate tobacco and/or components derived from tobacco.

Articles or devices of the present disclosure are also characterized as being vapor-producing articles, aerosol delivery articles, or medicament delivery articles. Thus, such articles or devices are adaptable so as to provide one or more substances in an inhalable form or state. For example, inhalable substances are substantially in the form of a vapor (i.e., a substance that is in the gas phase at a temperature lower than its critical point). Alternatively, inhalable substances are in the form of an aerosol (i.e., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like.

In use, smoking articles of the present disclosure are subjected to many of the physical actions of an individual in using a traditional type of smoking article (e.g., a cigarette, cigar, or pipe that is employed by lighting with a flame and used by inhaling tobacco that is subsequently burned and/or combusted). For example, the user of a smoking article of the present disclosure holds that article much like a traditional type of smoking article, draws on one end of that article for inhalation of an aerosol produced by that article, and takes puffs at selected intervals of time.

Smoking articles of the present disclosure generally include a number of elements provided or contained within an enclosure of some sort, such as a housing, an outer wrap or wrapping, a casing, a component, a module, a member, or the like. The overall design of the enclosure is variable, and the format or configuration of the enclosure that defines the overall size and shape of the smoking article is also variable. It is desirable, in some aspects, that the overall design, size, and/or shape of the enclosure resembles that of a conventional cigarette or cigar. Typically, an enclosure resembling the shape of a cigarette or cigar comprises three or more separable components, members, or the like that are engaged to form the enclosure. For example, such a smoking article comprises, in some aspects, three separable components that include a mouthpiece component, an aerosol delivery component, and a heat source component.

However, according to certain aspects of the present disclosure, it is advantageous to reduce the number of components required for assembly of such smoking articles. As such, the number of components of those smoking articles described herein is reduced, in some instances, from what is typically known in order to simplify assembly of smoking articles. Thus, in one example (see, for example, FIGS. 1A and 1B), a bi-component smoking article having two components is disclosed herein, wherein the aerosol delivery component and the mouthpiece component are combined to form a single component that is engageable with a heat source component for ease of assembly. Other simplifications of multi-component smoking article assemblies are also contemplated herein.

Smoking articles of the present disclosure comprise some combination of elements within the enclosure, such elements including, for example, a power source (e.g., an electrical power source), at least one control component (e.g., an actuation mechanism; an arrangement for actuating, controlling, regulating and ceasing power for heat generation, such as by controlling electrical current flow from the power source to other components of the article), a heat source or other heat generation element (e.g., a fuel element configured to be lit so as to burn by smoldering and to produce heat), an aerosol-delivery component (e.g., a substrate material associated with an aerosol precursor composition, solid tobacco and/or tobacco-related material, an aerosol-generating liquid, etc.), and a mouthpiece component, end region, portion, or tip for allowing draw upon the smoking article for aerosol inhalation therethrough (e.g., a defined air flow path through the article such that generated aerosol is directed therethrough in response to draw applied thereto). Alignment and arrangement of the elements within the article by way of the enclosure is variable. In specific aspects, the aerosol delivery component is disposed between a mouthpiece component and a heat and/or power source. Other configurations, however, are not excluded. For example, in some aspects, the power and/or heat source is disposed between the aerosol delivery component and the mouthpiece component.

Generally, the heat source is positioned sufficiently near the aerosol delivery component so that the aerosol formed/volatilized by the application of heat from the heat source to the aerosol delivery component (as well as one or more flavorants, medicaments, or the like that are likewise provided for delivery to a user) is deliverable to the user by way of the mouthpiece. That is, when the heat source heats the aerosol delivery component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements are appreciated upon consideration of commercially available electronic smoking articles, such as those representative products listed in the background art section of the present disclosure.

In various aspects, the heat source is formed of a material that generates heat in any number of ways. For example, the heat source is formed of a material that has a certain resistance and provides resistive heating when an electrical current is applied thereto. In another example, the heat source is formed of a combustible material that provides heat when the heat source is ignited. Regardless, the heat source is capable of generating heat to aerosolize an aerosol delivery component that comprises, for example, an extruded structure and/or substrate, a substrate material associated with an aerosol precursor composition, tobacco and/or a tobacco-derived material (i.e., a material that is found naturally in tobacco that is isolated directly from the tobacco or synthetically prepared) in a solid or liquid form (e.g., beads, shreds, a wrap), or the like.

In some aspects, the aerosol delivery component comprises a blend of flavorful and aromatic tobaccos in cut filler form. In another aspect, the aerosol delivery component comprises a reconstituted tobacco material, such as described in U.S. Pat. No. 4,807,809 to Pryor et al.; U.S. Pat. No. 4,889,143 to Pryor et al. and U.S. Pat. No. 5,025,814 to Raker, the disclosures of which are incorporated herein by reference in their entirety. Additionally, a reconstituted tobacco material includes a reconstituted tobacco paper for the type of cigarettes described in Chemical and Biological Studies on New Cigarette Prototypes that Heat Instead of Burn Tobacco, R. J. Reynolds Tobacco Company Monograph (1988), the contents of which are incorporated herein by reference in its entirety. For example, a reconstituted tobacco material includes a sheet-like material containing tobacco and/or tobacco-related materials. As such, in some aspects, the aerosol delivery component is formed from a wound roll of a reconstituted tobacco material. In another aspect, the aerosol delivery component is formed from shreds, strips, and/or the like of a reconstituted tobacco material.

According to another aspect, a smoking article according to the present disclosure includes an aerosol delivery component comprising a porous, inert material such as, for example, a ceramic material. In another aspect, the aerosol delivery component includes a porous, inert material that does not substantially react, chemically and/or physically, with a tobacco-related material such as, for example, a tobacco-derived extract.

Tobacco employed in the aerosol delivery component includes, or is derived from, tobaccos such as flue-cured tobacco, burley tobacco, Oriental tobacco, Maryland tobacco, dark tobacco, dark-fired tobacco and Rustica tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al.; U.S. Pat. No. 7,011,096 to Li et al.; U.S. Pat. No. 7,017,585 to Li et al.; U.S. Pat. No. 7,025,066 to Lawson et al.; U.S. Pat. App. Pub. No. 2004/0255965 to Perfetti et al.; PCT Pub. No. WO 02/37990 to Bereman; and Bombick et al., *Fund. Appl. Toxicol.,* 39, p. 11-17 (1997); the disclosures of which are incorporated herein by reference in their entireties.

According to another aspect of the present disclosure, an aerosol delivery component includes tobacco, a tobacco component, and/or a tobacco-derived material that has been treated, manufactured, produced, and/or processed to incorporate an aerosol precursor composition (e.g., humectants such as, for example, propylene glycol, glycerin, and/or the like) and/or at least one flavoring agent, as well as a burn retardant (e.g., diammonium phosphate and/or another salt) configured to help prevent ignition, pyrolysis, combustion, and/or scorching of the aerosol delivery component by the heat source. Various manners and methods for incorporating tobacco into smoking articles, and particularly smoking articles that are designed so as to not purposefully burn virtually all of the tobacco within those smoking articles are set forth in U.S. Pat. No. 4,947,874 to Brooks et al.; U.S. Pat. No. 7,647,932 to Cantrell et al.; U.S. Pat. No. 8,079,371 to Robinson et al.; U.S. Pat. No. 7,290,549 to Banerjee et al.; and U.S. Pat. App. Pub. No. 2007/0215167 to Crooks et al.; the disclosures of which are incorporated herein by reference in their entireties.

According to one aspect of the present disclosure, flame/burn retardant materials and additives that are included within the aerosol delivery component include organophosophorus compounds, borax, hydrated alumina, graphite, potassium tripolyphosphate, dipentaerythritol, pentaerythritol, and polyols. Others such as nitrogenous phosphonic acid salts, mono-ammonium phosphate, ammonium polyphosphate, ammonium bromide, ammonium borate, ethanolammonium borate, ammonium sulphamate, halogenated organic compounds, thiourea, and antimony oxides are suitable but are not preferred agents. In each aspect of flame-retardant, burn-retardant, and/or scorch-retardant materials used in the aerosol delivery component and/or other components (whether alone or in combination with each other and/or other materials), the desirable properties most preferably are provided without undesirable off-gassing or melting-type behavior.

According to another aspect of the present disclosure, the aerosol delivery component also incorporates tobacco additives of the type that are traditionally used for the manufacture of tobacco products. Those additives include the types of materials used to enhance the flavor and aroma of tobaccos used for the production of cigars, cigarettes, pipes, and the like. For example, those additives include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred casing materials include water, sugars and syrups (e.g., sucrose, glucose and high fructose corn syrup), humectants (e.g. glycerin or propylene glycol), and flavoring agents (e.g., cocoa and licorice). Those added components also include top dressing materials (e.g., flavoring materials, such as menthol). See, for example, U.S. Pat. No. 4,449,541 to Mays et al., the disclosure of which is incorporated herein by reference in its entirety. Further materials that are able to be added include those disclosed in U.S. Pat. No. 4,830,028 to Lawson et al. and U.S. Pat. No. 8,186,360 to Marshall et al., the disclosures of which are incorporated herein by reference in their entireties.

For example, in some aspects, a substrate material having an aerosol precursor composition associated therewith is provided in the aerosol delivery component. In this example, the aerosol precursor composition comprises one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, an aerosol delivery component produces a visible aerosol upon the application of sufficient heat thereto (and cooling with air, if necessary), and the aerosol delivery component produces an aerosol that is "smoke-like." In other aspects, the aerosol delivery component produces an aerosol that is substantially non-visible but is recognized as present by other characteristics, such as flavor or texture. Thus, the nature of the produced aerosol is variable depending upon the specific components of the aerosol delivery component. The aerosol delivery component is chemically simple relative to the chemical nature of the smoke produced by burning tobacco.

A wide variety of types of flavoring agents, or materials that alter the sensory or organoleptic character or nature of the mainstream aerosol of the smoking article are suitable to be employed. In some aspects, such flavoring agents are provided from sources other than tobacco and are natural or artificial in nature. Of particular interest are flavoring agents that are applied to, or incorporated within, the aerosol delivery component and/or those regions of the smoking article where an aerosol is generated. In some aspects, such agents are supplied directly to a heating cavity or region proximate to the heat source or are provided with the aerosol delivery component. Exemplary flavoring agents include vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, also are suitable to be employed. Flavoring agents also include acidic or basic characteristics (e.g., organic acids, such as levulinic acid, succinic acid, and pyruvic acid). The flavoring agents are combinable with the elements of the aerosol delivery component if desired. Exemplary plant-derived compositions that are suitable are disclosed in U.S. Pat. No. 9,107,453 and U.S. Pat. App. Pub. No. 2012/0152265 both to Dube et al., the disclosures of which are incorporated herein by reference in their entireties. The selection of such further components are variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

Any of the materials, such as flavorings, casings, and the like that are useful in combination with a tobacco material to affect sensory properties thereof, including organoleptic properties, such as described herein, are able to be combined with the aerosol delivery component. Organic acids particularly are able to be incorporated into the aerosol delivery component to affect the flavor, sensation, or organoleptic properties of medicaments, such as nicotine, that is able to be combined with the aerosol delivery component. For example, organic acids, such as levulinic acid, lactic acid, and pyruvic acid, are included in the aerosol delivery component with nicotine in amounts up to being equimolar (based on total organic acid content) with the nicotine. Any combination of organic acids is suitable. For example, in some instances, the aerosol delivery component includes about 0.1 to about 0.5 moles of levulinic acid per one mole of nicotine, about 0.1 to about 0.5 moles of pyruvic acid per one mole of nicotine, about 0.1 to about 0.5 moles of lactic acid per one mole of nicotine, or combinations thereof, up to a concentration wherein the total amount of organic acid present is equimolar to the total amount of nicotine present in the aerosol delivery component. Various additional examples of organic acids employed to produce an aerosol delivery component are described in U.S. Pat. App. Pub. No. 2015/0344456 to Dull et al., which is incorporated herein in its entirety by reference.

In still another aspect of the present disclosure, the aerosol delivery component is configured as an extruded structure and/or substrate that includes, or is essentially comprised of tobacco, tobacco-related material, glycerin, water, and/or a binder material, although certain formulations exclude the binder material. The binder material is any binder material commonly used for tobacco formulations including, for example, carboxymethyl cellulose (CMC), gum (e.g. guar gum), xanthan, pullulan, and/or an alginate. According to some aspects, the binder material included in the aerosol delivery component is configured to substantially maintain a structural shape and/or integrity of the aerosol delivery component. Various representative binders, binder properties, usages of binders, and amounts of binders are set forth in U.S. Pat. No. 4,924,887 to Raker et al., which is incorporated herein by reference in its entirety.

In another aspect, the aerosol delivery component includes a plurality of microcapsules, beads, granules, and/or the like having a tobacco-related material. For example, a representative microcapsule is generally spherical in shape, and has an outer cover or shell that contains a liquid center region of a tobacco-derived extract and/or the like. In some aspects, the aerosol delivery component includes a plurality of microcapsules each formed into a hollow cylindrical shape. In one aspect, the aerosol delivery component includes a binder material configured to maintain the structural shape and/or integrity of the plurality of microcapsules formed into the hollow cylindrical shape.

In some aspects, the aerosol delivery component is configured as an extruded material, as described in U.S. Pat. App. Pub. No. 2012/0042885 to Stone et al., which is incorporated herein by reference in its entirety. In yet another aspect, the aerosol delivery component includes an extruded structure and/or substrate formed from marumarized and/or non-marumarized tobacco. Marumarized tobacco is known, for example, from U.S. Pat. No. 5,105,831 to Banerjee, et al., which is incorporated by reference herein in its entirety. Marumarized tobacco includes about 20 to about 50 percent (by weight) tobacco blend in powder form, with glycerol (at about 20 to about 30 percent weight), calcium carbonate (generally at about 10 to about 60 percent by weight, often at about 40 to about 60 percent by weight), along with binder agents, as described herein, and/or flavoring agents.

The aerosol delivery component takes on a variety of conformations based upon the various amounts of materials utilized therein. For example, a useful aerosol delivery component comprises up to about 98% by weight, up to about 95% by weight, or up to about 90% by weight of a tobacco and/or tobacco material. A useful aerosol delivery component also comprises up to about 25% by weight, about 20% by weight or about 15% by weight water—particularly about 2% to about 25%, about 5% to about 20%, or about 7% to about 15% by weight water. Flavors and the like (which include, for example, medicaments, such as nicotine) comprise up to about 10%, up to about 8%, or up to about 5% by weight of the aerosol delivery component.

Additionally or alternatively, the aerosol delivery component is configured as an extruded structure and/or a substrate that includes or essentially is comprised of tobacco, glycerin, water, and/or binder material, and is further configured to substantially maintain its structure throughout the aerosol-generating process. That is, the aerosol delivery component is configured to substantially maintain its shape (i.e., the aerosol delivery component does not continually deform under an applied shear stress) throughout the aerosol-generating process. Although the aerosol delivery component includes liquids and/or some moisture content, the aerosol delivery component remains substantially solid throughout the aerosol-generating process and substantially maintains structural integrity throughout the aerosol-generating process. Exemplary tobacco and/or tobacco related materials suitable for a substantially solid aerosol delivery component are described in U.S. Pat. App. Pub. No. 2015/0157052 to Ademe et al.; U.S. Pat. App. Pub. No. 2015/0335070 to Sears et al.; U.S. Pat. No. 6,204,287 to White; and U.S. Pat. No. 5,060,676 to Hearn et al., which are all incorporated herein in their entirety by reference respectively.

Additionally or alternatively, the aerosol delivery component is configured as a liquid capable of yielding an aerosol upon application of sufficient heat, having ingredients commonly referred to as "smoke juice," "e-liquid" and "e-juice". Exemplary formulations for an aerosol-generating liquid are described in U.S. Pat. Pub. No. 2013/0008457 to Zheng et al., the disclosure of which is incorporated herein by reference in its entirety.

The amount of aerosol delivery component that is used within the smoking article is such that the article exhibits acceptable sensory and organoleptic properties, and desirable performance characteristics. For example, it is highly preferred that sufficient aerosol precursor composition such as, for example, glycerin and/or propylene glycol, be employed within the aerosol delivery component in order to provide for the generation of a visible mainstream aerosol that in many regards resembles the appearance of tobacco smoke. Typically, the amount of aerosol precursor composition incorporated into the aerosol delivery component of the smoking article is in the range of about 1.5 gram or less, about 1 gram or less, or about 0.5 gram or less.

In some additional aspects, the smoking article disclosed herein comprises one or more indicators or indicia. Such indicators or indicia include, for example, lights (e.g., light emitting diodes) that provide indication(s) of multiple aspects of use of the inventive article. Further, in another example, LED indicators are positioned at the distal end of the smoking article to simulate color changes seen when a conventional cigarette is lit and drawn on by a user. Other indices of operation are also encompassed by the present disclosure. For example, visual indicators of operation also include changes in light color or intensity to show progression of the smoking experience. Tactile indicators of operation and sound indicators of operation similarly are encompassed by the disclosure. Moreover, combinations of such indicators of operation also are suitable to be used in a single smoking article. According to another aspect, the smoking article includes one or more indicators or indicia, such as, for example, a display configured to provide information corresponding to the operation of the smoking article such as, for example, the amount of power remaining in the power source, progression of the smoking experience, indication corresponding to activating a heat source, and/or the like.

Accordingly, although a variety of materials for use in a smoking article according to the present disclosure have been described above—such as heaters, batteries, capacitors, switching components, aerosol delivery components, aerosol precursor compositions, and/or the like, the disclosure should not be construed as being limited to only the exemplified aspects. Rather, one of skill in the art recognizes, based on the present disclosure, similar components in the field that are interchangeable with any specific component of the present disclosure. For example, U.S. Pat. No. 5,261,424 to Sprinkel, Jr. discloses piezoelectric sensors that are associated with the mouth-end of a device to detect user lip activity associated with taking a draw and to then trigger heating; U.S. Pat. No. 5,372,148 to McCafferty et al. discloses a puff sensor for controlling energy flow into a heating load array in response to a pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; U.S. Pat. No. 8,402,976 to Fernando et al. discloses computer interfacing means for smoking devices to facilitate charging and allow computer control of the device; and U.S. Pat. No. 8,689,804 to Fernando et al. discloses identification systems for smoking devices; all of the foregoing disclosures being incorporated herein by reference in their entireties. Further examples of components related to electronic aerosol delivery articles and disclosing materials or components that are suitable to be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,204,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; U.S. Pat. Nos. 8,156,944, 8,375,957 to Hon; U.S. Pat. Pub. Nos. 2006/0196518 and 2009/0188490 to Hon; U.S. Pat. No. 8,794,231 to Thorens et al.; U.S. Pat. Nos. 8,915,254 and 8,925,555 to Monsees et al.; U.S. Pat. No. 8,851,083 and U.S. Pat. Pub. No. 2010/0024834 to Oglesby et al.; U.S. Pat. Pub. No. 2010/0307518 to Wang; and WO 2010/091593 to Hon. A variety of the materials disclosed by the foregoing documents is able to be incorporated into the present devices in various aspects, and all of the foregoing disclosures are incorporated herein by reference in their entireties.

Although a smoking article according to the disclosure takes on a variety of aspects, as discussed in detail below, the use of the smoking article by a consumer will be similar in scope. The foregoing description of use of the smoking article is applicable to the various aspects described through minor modifications, which are apparent to the person of skill in the art in light of the further disclosure provided herein. The above description of use, however, is not intended to limit the use of the inventive article but is provided to comply with all necessary requirements of disclosure herein.

Referring now to FIGS. 1A and 1B, a first embodiment of a smoking article is disclosed. The smoking article 100 advantageously provides a bi-component smoking article that utilizes two separable components as compared to three or more separable components. The two separable components are joined together with an outer wrap, described in more detail below, for advantageously simplified assembly for a consumer.

In some aspects, the smoking article 100 comprises a heat source 102 configured to generate heat upon ignition thereof. The heat source 102 comprises, for example, a combustible fuel element that has a generally cylindrical shape and incorporates a combustible carbonaceous material. Carbonaceous materials generally have high carbon contents. Preferred carbonaceous materials are composed predominately of carbon, typically have carbon contents of greater than about 60 percent, generally greater than about 70 percent, often greater than about 80 percent, and frequently greater than about 90 percent, on a dry weight basis.

In some instances, the heat source 102 incorporates elements other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; and/or binding agents, such as guar gum, ammonium alginate and sodium alginate). In some aspects, the heat source 102 comprises a length of about 12 mm and an overall outside diameter of about 4.2 mm. In other aspects, the heat source 102 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 5,551,451 to Riggs et al. and U.S. Pat. No. 7,836,897 to Borschke et al., which are incorporated herein by reference in their entirety.

As such, and as illustrated in FIGS. 1A and 1B, the heat source 102 comprises an extruded monolithic carbonaceous material defining one or more channels 104 extending longitudinally from a first end of the extruded monolithic carbonaceous material to an opposing second end of the extruded monolithic carbonaceous material. However, in other aspects, the heat source 102 comprises alternative configurations such as a substantially circular cross-section or the heat source 102 defines flutes or slits extending longitudinally from a first end of the extruded monolithic carbonaceous material to an opposing second end thereof. Further, in some additional aspects, the heat source 102 comprises a foamed carbon monolith formed in a foam process of the type disclosed in U.S. Pat. No. 7,615,184 to Lobovsky, which is incorporated herein by reference. This embodiment provides advantages with regard to reduced time taken to ignite the heat source 102. In another embodiment, the heat source 102 is co-extruded with a layer of insulation (not shown), thereby reducing manufacturing time and expense. Still other embodiments of fuel elements include carbon fibers of the type described in U.S. Pat. No. 4,922,901 to Brooks et al. or other heat source embodiments such as is disclosed in U.S. Pat. App. Pub. No. 2009/0044818 to Takeuchi et al., each of which is incorporated herein by reference.

The smoking article 100 further comprises, in some aspects, a first substrate material 106 having opposed first and second ends. As illustrated in FIG. 1A, the first end of the first substrate material 106 is fixedly engaged with the heat source 102 in a variety of ways including being bonded, welded, screwed, or otherwise joined to the heat source 102. The heat source 102 and the first substrate material 106 have, in some aspects, substantially similar shapes and/or measurements such that upon fixed engagement, the two form an integral unit (e.g., a cylinder). In this manner, the first substrate material 106 and the heat source 102 form a first component of the bi-component design of the smoking article 100.

The first substrate material 106 comprises, in some aspects, a material having a variety of inherent characteristics or properties. For example, the first substrate material 106 comprises a plasticized material or regenerated cellulose in the form of rayon. As another example, viscose (commercially available as VISIL®), which is a regenerated cellulose product incorporating silica, is suitable. Preferred carbon fibers include at least 95 percent carbon or more. Similarly, natural cellulose fibers such as cotton are suitable, and preferably are infused or otherwise treated with silica, carbon, or metallic particles to enhance flame-retardant properties and minimize off-gassing, particularly of any undesirable off-gassing components that would have a negative impact on flavor (and especially minimizing the likelihood of any toxic off-gassing products). As is known in the art, cotton is treatable with, for example, boric acid or various organophosphate compounds to provide desirable flame-retardant properties by dipping, spraying or other techniques known in the art. These fibers are also treatable (coated, infused, or both by, e.g., dipping, spraying, or vapor-deposition) with organic or metallic nanoparticles to confer the desired property of flame-retardancy without undesirable off-gassing or melting-type behavior.

In this manner, the first substrate material 106 has an aerosol precursor composition associated therewith (i.e., treated, coated, impregnated, etc.). As noted herein, the aerosol precursor composition includes humectants such as, for example, propylene glycol, glycerin, and/or the like and/or at least one flavoring agent, as well as a burn retardant (e.g., diammonium phosphate and/or another salt) configured to help prevent ignition, pyrolysis, combustion, and/or scorching of the aerosol delivery component associated with the first substrate material 106 by the heat source 102.

In some aspects, the smoking article 100 further comprises an aerosol delivery component 108 having opposed first and second ends. The aerosol delivery component 108 comprises a centrally defined longitudinally extending axis between each of the opposed first and second ends. A cross-section of the aerosol delivery component 108 is, in some aspects, symmetrical about the axis. For example, the cross-section of the aerosol delivery component 108 is substantially circular such that the aerosol delivery component defines a substantially cylindrical shape extending between the opposed first and second ends thereof. However, in other aspects, the aerosol delivery component 108 defines a substantially non-circular cross-section such that the aerosol delivery component 108 defines a substantially non-cylindrical shape between the opposed first and second ends thereof. Otherwise, in other examples, the aerosol delivery component 108 comprises an asymmetric cross-section about the axis.

Each end of the aerosol delivery component 108 is, in some aspects, in axial alignment with adjacent elements. For example, the first end of the aerosol delivery component 108 is configured to be in coaxial alignment with the second end of the first substrate material 106 upon engagement therebetween. As such, the aerosol delivery component 108 is the second component in the bi-component design of the smoking article 100. Thus, when the first end of the aerosol delivery component 108 is engaged with the second end of the first substrate material 106, the smoking article 100 is assembled for use.

To engage or otherwise join together the first end of the aerosol delivery component 108 with the second end of the first substrate material 106, an outer wrap material 110 is provided, as illustrated in FIG. 1B. The outer wrap material 110 is configured, in some aspects, to circumscribe, e.g., coaxially encircle, the heat source 102, the first substrate material 106 engaged about the first end thereof with the heat source 102, and the aerosol delivery component 108 engaged with the second end of the first substrate material 106. The outer wrap material 110 is configured to be retained in a wrapped position in any manner of ways including an adhesive, a fastener, and the like, to allow the outer wrap material 110 to remain in the wrapped position. Otherwise, in some other aspects, the outer wrap material 110 is configured to be removable as desired. For example, upon retaining the outer wrap material 110 in the wrapped position, the outer wrap material 110 is able to then be removed from the heat source 102, the first substrate material 106 engaged with the heat source 102 about the first end thereof, and the aerosol delivery component 108 engaged with the second end of the first substrate material 106. In this example, the adhesive, fastener, or the like is removed and the outer wrap material 110 is uncircumscribed thereabout.

In some aspects, the outer wrap material 110 comprises a liner material 112 disposed adjacent to the heat source 102, the first substrate material 106, and the aerosol delivery component 108. In such instances, the outer wrap material 110 and the liner material 112 are separate materials that are provided together (e.g., bonded, fused, or otherwise joined together as a laminate). In other instances, the outer wrap material 110 and the liner material 112 are the same material. Regardless, the liner material 112 is configured, in these instances, to thermally regulate conduction of the heat generated by the ignited heat source 102, radially outward of the liner material 112. To do so, the liner material 112 comprises, in some aspects, a material selected from the group consisting of foil, graphene, graphite, and aluminum oxide. In some embodiments, depending on the material of the outer wrap material 110 and/or the liner material 112, a thin layer of insulation may be provided radially outward of the outer wrap material 110. Thus, the outer wrap material 110 advantageously provides, in some aspects, a manner of engaging the two separate components of the smoking article 100, while also providing a manner of facilitating heat transfer axially therealong, but restricting radially outward heat conduction.

In some aspects, a second substrate material 114 is provided with the aerosol delivery component 108. Specifically, the second substrate material 114 has the aerosol precursor composition associated therewith (i.e., treated, coated, impregnated, etc.) and is disposed about the first end of the aerosol delivery component 108. The aerosol precursor composition associated with the second substrate material 114 is substantially the same or similar to the aerosol precursor composition associated with the first substrate material 106. Otherwise, in other aspects, the first substrate material 106 has an aerosol precursor composition associated therewith that is different than the aerosol precursor composition associated with the second substrate material 114.

Further, the second substrate material 114 comprises a material substantially similar to or the same as the first substrate material 106. Otherwise, in other aspects, the first substrate material 106 and the second substrate material 114 comprise different materials. In some instances, the first substrate material 106 and the second substrate material 114 comprise cellulose acetate material and the aerosol precursor composition comprises glycerin coated on the cellulose acetate of the first substrate material 106 and the second substrate material 114.

The second end of the aerosol delivery component 108 opposing the first end engaged with the second end of the first substrate material 106 includes a mouthpiece 116 having a filter material 118. Components of the aerosol produced by heat from the heat source 102 during use of the smoking article 100 are drawn through the mouthpiece 116 and the filter material 118 during draw on the mouthpiece 116 by the user.

A cylindrical housing 120 defining a cavity 122 for receiving and retaining tobacco material 124, the cavity being disposed between the second substrate material 114 and the mouthpiece 116 of the aerosol delivery component 108, is illustrated, for example, in FIG. 1A. The tobacco material 124 comprises, in some aspects, tobacco-containing beads, tobacco shreds, tobacco strips, pieces of a reconstituted tobacco material, or combinations thereof. As such, the tobacco material 124 is disposed between the second substrate material 114 and the mouthpiece 116 in a "dry" manner, such that the tobacco material 124 is not directly associated with the aerosol precursor composition as compared with other products where dry heat from a heat source aerosolizes an aerosol precursor composition directly associated with tobacco material. Instead, the aerosol precursor composition is associated with the first and second substrate materials 106, 114 and is configured to produce an aerosol in response to the heat generated by the ignited heat source 102. The aerosol is then drawn across the tobacco material 124 and through the filter material 118 of the mouthpiece 116 in response to a draw applied to the mouthpiece 116.

Specifically, ignition of the heat source 102 results in aerosolization of the aerosol precursor composition associated with each of the first substrate material 106 and the second substrate material 114. Preferably, the elements of the first substrate material 106 and the second substrate material 114 do not experience thermal decomposition (e.g., charring, scorching, or burning) to any significant degree. The aerosolized components are entrained in the air that is drawn through an aerosol-generating region (not shown). The aerosol so formed is drawn through the filter material 118, and into the mouth of the smoker.

Accordingly, the second component of the smoking article, namely the aerosol delivery component 108, is advantageously formed from the integration of the mouthpiece 116 and the filter material 118 with the second substrate material 114 and the tobacco material 124. By integrating these components of the aerosol delivery component 108, assembly complexity of the aerosol delivery component 108 with the first component, namely the heat source 102 and first substrate material 106, is reduced. As such, the first component (heat source 102 and first substrate material 106) is simply joined together with the second component (aerosol delivery component 108) by way of the outer wrap material 110. As illustrated in FIG. 1B, the outer wrap material 110 is configured to circumscribe the first and second components, such that the smoking article 100 is formed as a cigar or cigarette look-alike to simulate a smoking experience for the consumer, while reducing the traditional number of smoking article components from three to two.

Referring now to FIGS. 2A-2D, a second embodiment of a smoking article is disclosed. The smoking article 200, FIG. 2D, advantageously provides a reloadable aerosol-producing module 202 that is configured to be received in a tubular casing 204 comprised of a thermally-insulating material. The thermally-insulating material of the tubular casing 204 advantageously provides a reduction in exterior temperature of the reloadable aerosol-producing module 202 as compared with traditional aerosol-producing modules 202 that lack a thermally-insulating casing.

More specifically, in some aspects, the aerosol-producing module 202 of the smoking article 200 comprises a heat source 206 configured to generate heat upon ignition thereof. The heat source 206 comprises, for example, a combustible fuel element that has a generally cylindrical shape and incorporates a combustible carbonaceous material, similar to that described above in reference to the heat source 102. As such, and as illustrated in FIG. 2A, the heat source 206 comprises an extruded monolithic carbonaceous material defining one or more channels 208 extending longitudinally from a first end of the extruded monolithic carbonaceous material to an opposing second end of the extruded monolithic carbonaceous material. However, in other aspects, the heat source 206 comprises alternative configurations such as a substantially circular cross-section, or the heat source 206 defines flutes or slits extending longitudinally from a first end of the extruded monolithic carbonaceous material to an opposing second end thereof.

The aerosol-producing module 202 further comprises, in some aspects, an aerosol delivery component 210 having opposed first and second ends. The aerosol delivery component 210 in some aspects comprises a centrally defined longitudinally extending axis between each of the opposed first and second ends. A cross-section of the aerosol delivery component 210 is, in some aspects, symmetrical about the axis. For example, the cross-section of the aerosol delivery component 210 is substantially circular such that the aerosol delivery component defines a substantially cylindrical shape extending between the opposed first and second ends thereof. In this example, and as illustrated in FIG. 2A, the aerosol delivery component 210 comprises a tubular member 212. However, in other aspects, the aerosol delivery component 210 defines a substantially non-circular cross-section such that the aerosol delivery component 210 defines a substantially non-cylindrical shape between the opposed first and second ends thereof. In these examples, the aerosol delivery component 210 comprises a non-tubular member (not shown). Otherwise, in other examples, the aerosol delivery component 210 comprises an asymmetric cross-section about the axis.

The tubular member 212 of the aerosol delivery component 210, regardless of the cross-section, comprises a material that is substantially rigid or inflexible along its longitudinal axis. In addition, the tubular member 212 comprises a material that is essentially biodegradable. Accordingly, it is desirable that the tubular member 212 of the aerosol delivery component 210 comprise extruded carbon or graphite, such that the tubular member 212 exhibits rigidity while still being essentially biodegradable. As illustrated in FIG. 2A, the tubular member 212 is hollow member defining a cavity extending between the opposed first and second ends. In some instances, for example, the tubular member 212 is a hollow cylinder comprised of extruded carbon or graphite.

Each end of the aerosol delivery component 210 is, in some aspects, in axial alignment with an element of the aerosol-producing module 202 upon assembly therewith. For example, the first end of the aerosol delivery component 210 is axially engageable with the heat source 206. In this example, the first end of the aerosol delivery component 210 is engageable with the heat source 206 via a wrapping material 214. FIG. 2B illustrates, for example, the wrapping material 214 that is configured to circumscribe at least the heat source 206 and the aerosol delivery component 210 of the aerosol-producing module 202 to engage the heat source 206 with the first end of the aerosol delivery component 210. The wrapping material 214 is configured to be retained in a wrapped position about the heat source 206 and the aerosol delivery component 210 in any number of ways including an adhesive, a fastener, and the like, to allow the wrapping material 214 to remain in a fixed position.

Further illustrated in FIG. 2A, in one example, the aerosol delivery component 210 comprises a tobacco material 216 associated with an aerosol precursor composition and disposed within the tubular member 212. More particularly, the interior cavity of the tubular member 212 is configured to receive the tobacco material 216 associated with the aerosol precursor composition, such that the tobacco material 216 associated with the aerosol precursor composition is packed, inserted, poured, or otherwise disposed within the tubular member 212 between the opposed first and second ends. The tobacco material 216 comprises, in some aspects, tobacco-containing beads, tobacco shreds, tobacco strips, pieces of a reconstituted tobacco material, or combinations thereof. The aerosol precursor composition associated therewith includes humectants such as, for example, propylene glycol, glycerin, and/or the like and/or at least one flavoring agent, as well as a burn retardant (e.g., diammonium phosphate and/or another salt) configured to help prevent ignition, pyrolysis, combustion, and/or scorching of the tobacco material 216 and/or the wrapping material 214 by the heat source 206.

As compared with the smoking article 100 described above in reference to FIGS. 1A and 1B, the smoking article 200 utilizes tobacco material 216 coated with the aerosol precursor composition prior to disposition of the tobacco material 216 in the tubular member 212. Alternatively, the tobacco material 216 is disposed in the tubular member 212 and then coated with the aerosol precursor composition. Regardless, the tobacco material 216 is "wet" when heated by the heat source 206, such that the aerosol precursor composition associated with the tobacco material 216 is configured to produce an intense and highly flavorful aerosol in response to the heat generated by the heat source 206.

A mouthpiece 218 is engaged with the second end of the aerosol delivery component 210, axially opposed to the first end of the aerosol delivery component engaged with the heat source 206. The mouthpiece 218 is configured to receive the aerosol therethrough in response to a draw applied to the mouthpiece 218 by a user. The mouthpiece 218 is, in some aspects, fixedly engaged to the aerosol delivery component 210. For example, an adhesive, a bond, a weld, and the like are suitable for fixedly engaging the mouthpiece 218 to the aerosol delivery component 210. In one example, the mouthpiece is ultrasonically welded and sealed to the second end of the aerosol delivery component 210.

The mouthpiece 218 further comprises, in some aspects a filter material 220 configured to receive the aerosol therethrough in response to the draw applied to the mouthpiece 218. The filter material 220 is provided, in some aspects, as a circular disk radially and/or longitudinally disposed between the second end of the tubular member 212 and the mouthpiece 218. In this manner, upon draw on the mouthpiece 218, the filter material 220 receives the aerosol flowing through the tubular member 212 of the aerosol delivery component 210.

In still further aspects, the aerosol delivery component 210 comprises an annulus 222 extending around the second end of the tubular member 212 and configured to engage the mouthpiece 218. The annulus 222 is configured to act as a sealing mechanism between the mouthpiece 218 and the tubular member 212 of the aerosol delivery component 210 to prevent ambient air from entering a flow path defined along the longitudinal axis of the aerosol-producing module 202. The annulus 222 comprises, in some aspects, a diameter larger than that of the tubular member 212, but small enough to be sealingly received within an interior of the mouthpiece 218. The annulus 222 is configured to be fixedly secured at the second end of the tubular member 212 via an adhesive, a bond, a weld, and the like. For example, the annulus 222 is ultrasonically welded or sealed to the mouthpiece 218 or to the second end of the tubular member 212. In such aspects, the mouthpiece 218 having the annulus 222 welded or sealed thereto is configured for the annulus 222 to receive the second end of the tubular member 212. In other such aspects, the mouthpiece 218 is configured to receive the annulus 222 therein, with the annulus being welded or sealed to the second end of the tubular member 212. Where the filter material 220 is included within the mouthpiece, the filter material 220 is disposed radially and/or longitudinally between the annulus 222 and the mouthpiece 218.

In order to render the aerosol-producing module 202 essentially biodegradable, at least one of the annulus 222 and the mouthpiece 218 comprises a biodegradable material. For example, at least one of the annulus 222 and the mouthpiece 218 comprises a biodegradable plastic such as polyhydroxyalkonoate (PHA). In various aspects, the filter material 220 comprises a biodegradable material or comprises a non-biodegradable material such as cellulose acetate, which is easily removed prior to composting the aerosol-producing module 202.

An exemplary embodiment of the tubular casing 204 is illustrated in greater detail in FIG. 2C. The tubular casing 204 is comprised of a thermally-insulating material. For example, the thermally-insulating material of the tubular casing 204 comprises a ceramic material, graphene, graphite, or the like. Otherwise, the thermally-insulating material of the tubular casing 204 is such that it is able to distribute and dissipate heat generated from the heat source 206 such that the external surface temperature of the tubular casing 204, especially near the heat source 206, is not excessively hot. The configuration of tubular casing 204 also reduces the likelihood of scorching of the external surface thereof near the heat source 206.

The tubular casing 204 is configured, in some aspects, to be able to receive at least the heat source 206 and the aerosol delivery component 210 of the aerosol-producing module 202 therein in coaxial relation with each other (i.e., serially disposed). Where the wrapping material 214 is utilized to engage the heat source 206 with the first end of the aerosol delivery component 210, the tubular casing 204 is configured to removeably receive at least the heat source 206 and the aerosol delivery component 210 of the aerosol-producing module 202 circumscribed by the wrapping material 214. As such, the tubular casing 204 is designed, sized, and/or shaped to be larger than each of at least the heat source 206 and the aerosol delivery component 210 of the aerosol-producing module 202 unwrapped or otherwise wrapped in the wrapping material 214.

FIG. 2D illustrates the tubular casing 204 having at least the heat source 206 and the aerosol delivery component 210 of the aerosol-producing module 202 received therein in coaxial relation with each other. The heat source 206 and the aerosol delivery component 210 of the aerosol-producing module 202 are configured to be slid into an open end of the tubular casing 204. As such, upon receipt of at least the heat source 206 and the aerosol delivery component 210 of the aerosol-producing module 202 therein, the tubular casing 204 is configured to thermally regulate conduction of the heat generated by the ignited heat source 206 therethrough (i.e., radially outward). Specifically, ignition of the heat source 206 results in aerosolization of the aerosol precursor composition associated with the tobacco material 216 disposed within the tubular member 212. Preferably, the elements of the tobacco material 216 do not experience thermal decomposition (e.g., charring or burning) to any significant degree. The aerosolized components are thus entrained in the air that is drawn through the aerosol-generating region (i.e., the tobacco material 216). The aerosol so formed will be drawn through the filter material 220, and into the mouth of the smoker.

Advantageously, the aerosol-producing module 202 and the tubular casing 204 are provided together in a packaged unit. For example, a packaged unit includes one or more aerosol-producing modules 202 that are configured to be utilized by a smoker and then disposed of (e.g., composted), while the tubular casing 204 is configured to be reused with each new aerosol-producing module 202. In this example, the mouthpiece 218 of each aerosol-producing module 202 is configured to be removeably engaged with the tubular casing 204 via various engagement mechanisms including a snap-fit engagement, a press-fit engagement, a threaded engagement, an adhesive, a bond, a weld, and the like. Thus, a user is able to engage the mouthpiece 218 of a new aerosol-producing module 202 with the tubular casing 204 prior to igniting the heat source 206.

Referring now to FIGS. 3A-3C, a third embodiment of a smoking article is disclosed. The smoking article 300, FIG. 3C, advantageously provides for a power source configured to heat a small quantity of tobacco material to reduce the overall heat generated during use as compared with a conventional smoking article.

More particularly, a disassembled view of the smoking article 300 is illustrated in FIG. 3A. The smoking article 300 comprises, in some aspects, a power source 302. In some instances, the power source takes on various aspects. Preferably, the power source 302 is able to deliver sufficient power to rapidly provide for aerosol formation by the tobacco material and to power the article 300 through use for the desired duration of time. The power source 302 preferably is sized to fit conveniently within the article 300 so that the article is easily handled; and additionally, a preferred power source 302 is of a sufficiently light weight to not detract from a desirable smoking experience.

The power source 302 is, in some aspects, an electrical power source that is configured to produce, generate, or otherwise provide electrical power. For example, the power source 302 comprises a lithium-ion battery that is desirably rechargeable (e.g., a rechargeable lithium-manganese dioxide battery). In particular, lithium polymer batteries are usable as such batteries provide increased safety. Other types of batteries—e.g., N50-AAA CADNICA nickel-cadmium cells—also are useable. Even further examples of batteries that are useable according to the disclosure are described in U.S. Pat. No. 9,484,155 to Peckerar et al., the disclosure of which is incorporated herein by reference in its entirety. In some aspects, thin film batteries are used in certain aspects of the disclosure. Any of these batteries or combinations thereof is used in the power source, but rechargeable batteries are preferred because of cost and disposal considerations associated with disposable batteries. In aspects where disposable batteries are provided, the smoking article 300 includes access for removal and replacement of the battery. Alternatively, in aspects where rechargeable batteries are used, the smoking article 300 comprises charging contacts (not shown), for interaction with corresponding contacts in a conventional recharging unit deriving power from a standard 120-volt AC wall outlet, or other sources such as an automobile electrical system or a separate portable power supply, including USB connections. An arrangement for recharging the battery is provided in some aspects in a portable charging case that includes, for example, a relatively larger battery unit that provides multiple charges for the relatively smaller batteries present in the smoking article 300. Alternatively, in some aspects, the smoking article 300 includes elements for providing a non-contact inductive recharging system such that the smoking article 300 is charged without being physically connected to an external power source. Thus, the smoking article 300 includes in some instances elements to facilitate transfer of energy from an electromagnetic field to the rechargeable battery within the smoking article 300.

In some aspects, the power source 302 also comprises one or more capacitors. For example, the power source 302 includes a combination of any number of batteries and/or capacitors. In some aspects, the power source 302 includes at least one battery and at least one capacitor. Capacitors are capable of discharging more quickly than batteries and are chargeable between puffs, allowing the battery to discharge into the capacitor at a lower rate than if it were used to power a heat source directly. For example, a supercapacitor—i.e., an electric double-layer capacitor (EDLC)—is disposed separate from or in combination with a battery. When used alone, the supercapacitor is recharged before each use of the smoking article 300. Thus, a charger component is attachable to the smoking article 300 between uses to replenish the supercapacitor.

The smoking article 300 further includes, in some aspects, a variety of power management software, hardware, and/or other electronic control components (not shown). For example, such software, hardware, and/or electronic controls includes functionality such as carrying out charging of the battery, detecting the battery charge and discharge status, performing power save operations, preventing unintentional or over-discharge of the battery, and/or the like.

Regardless of its implementation, in some aspects and as illustrated in FIG. 3A, the power source 302 has opposed first and second ends defining an axis extending therethrough. A cross-section of the power source 302 is, in some aspects, symmetrical about the axis. For example, the cross-section of the power source 302 is substantially circular such that the power source 302 defines a substantially cylindrical shape extending between the opposed first and second ends thereof. In this example, and as illustrated in FIG. 3A, the power source 302 is housed in a tubular control enclosure 304 having opposed first and second ends and defining an axis therebetween. In this example, the power source 302 is disposed within an interior of the tubular control enclosure 304 such that the power source 302 and tubular control enclosure 304 are in coaxial alignment with each other.

However, in other aspects, the power source 302 and/or tubular control enclosure 304 defines a substantially non-circular cross-section such that the power source 302 and/or tubular control enclosure 304 defines a substantially non-cylindrical shape between the opposed first and second ends thereof. In these examples, the power source 302 and/or tubular control enclosure 304 comprises a non-tubular member (not shown). Otherwise, in other examples, the power source 302 and/or tubular control enclosure 304 comprises an asymmetric cross-section about the axis.

The smoking article 300 further comprises, in some aspects, a heat source 306 in communication with the second end of the power source 302 and extending along the axis. The heat source 306 is configured to generate conductive heat, radiative heat, inductive heat, and/or the like in response to power received from the power source 302.

In some aspects, the heat source 306 implements electrically conductive materials, wherein such materials useful as heat sources are those having low mass, low density, and moderate resistivity and that are thermally stable at the temperatures experienced during use. Useful heat sources heat and cool rapidly, and thus provide for the efficient use of energy. Rapid heating provides almost immediate aerosolization, while rapid cooling (i.e., to a temperature below the volatilization temperature of the aerosol delivery component/component/composition/material) prevents substantial volatilization (and hence waste) during periods when aerosol formation is not desired. Such heat sources also permit relatively precise control of the temperature range, especially when time based current control is employed.

Accordingly, in some aspects, for example, the heat source 306 comprises an electrically conductive material (i.e., for resistance heating) in order to promote rapid heating and cooling of the solid tobacco material provided in proximity thereto. Exemplary electrically conductive materials suitable for the heat source 306 preferably are chemically non-reactive with the material being heated so as not to adversely affect the flavor or content of the aerosol or vapor that is produced. Exemplary, non-limiting, materials that are suitable as the electrically conductive material include carbon, graphite, carbon/graphite composites, metals, metallic and non-metallic carbides, ceramics, nitrides, silicides, intermetallic compounds, cermets, metal alloys, and metal foils. In particular, refractory materials are useful. Various, different materials are able to be mixed to achieve the desired properties of resistivity, mass, and thermal conductivity. In specific aspects, metals that are able to be utilized include, for example, nickel, chromium, alloys of nickel and chromium (e.g., nichrome), and steel. Materials that are useful for providing resistance or resistive heating are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties.

The heat source 306 is able to be provided in a variety forms, such as in the form of a foil, a foam, discs, spirals, fibers, wires, films, yarns, strips, ribbons, or cylinders. In some aspects, the heat source 306 according to the present disclosure is a conductive substrate, such as that described in U.S. Pat. App. Pub. No. 2013/0255702 to Griffith et al., the disclosure of which is incorporated herein by reference in its entirety. As particularly illustrated in FIG. 3B, the heat source 306 comprises, for example, a heating element such as a cylindrical rod configured to generate heat in response to power received from the power source 302. In this instance, where the heat source 302 is a lithium-ion battery, the cylindrical rod is electrically connected to the lithium-ion battery for providing electrical power to the cylindrical rod. Such electrical connections are formed from a hard-wired connection (not shown).

In some aspects, the heat source 306 is housed within a tubular casing 308 having opposed first and second ends. The tubular casing 308 defines an axis extending between the opposed first and second ends and is designed with a shape and/or cross-section similar to that of the tubular control enclosure 304. For example, where the tubular control enclosure 304 comprises a cylindrical shape, the tubular casing 308 comprises a cylindrical shape. However, the tubular casing 308 and the tubular control enclosure 304 also define different shapes in alternative embodiments.

The tubular casing 308 is configured to comprise an insulating material. For example, the insulating material of the tubular casing 308 comprises graphite, graphene, and the like in order to regulate conduction of the heat generated by the heat source 306. Notably, the anisotropic thermal conductive properties of graphite, graphene, and the like are desirable for regulating conduction of heat generated by the heat source 306. Thus, by housing the heat source 306 within the tubular casing 308 comprising one of these materials, the heat produced by the heat source 306 is regulated by the tubular casing 308 so that an external surface of the smoking article 300 is not subjected to high levels of heat during use.

In some aspects, the first end of the tubular casing 308 is configured to be engaged with the second end of the power source 302 by way of the second end of the tubular control enclosure 304. For example, an engagement mechanism such as a threaded engagement, a wrapping material, a press-fit engagement, and the like are used to engage the second end of the tubular control enclosure 304 with the first end of the tubular casing 308. As such, the second end of the power source 302 housed within the tubular control enclosure 304 and the first end of the heat source 306 housed within the tubular casing 308 are in communication with one another.

A solid tobacco material 310 is, in some aspects, also housed within the tubular casing 308. In some instances, the solid tobacco material 310 is configured as a cylindrical tube extending about a circumferential surface of the axially-extending heat source 306, between the heat source 306 and the tubular casing 308. For example, and as particularly illustrated in FIG. 3B, the solid tobacco material 310 is distributed about a circumferential surface of the axially-extending heat source 306 in a substantially even thickness thereabout. Such an arrangement is beneficial as it enables the heat source 306 to be positioned in intimate contact with or in close proximity to the solid tobacco material 310 to produce an aerosol in response to the heat generated by the heat source 306.

The solid tobacco material 310 comprises, in some instances, tobacco-containing beads, tobacco shreds, tobacco strips, pieces of a reconstituted tobacco material, or combinations thereof. The solid tobacco material 310 is formed as an extruded, annular cylinder that is received over the circumferential surface of the axially-extending heat source 306 within the tubular casing 308. Otherwise, the solid tobacco material 310 is packed, dropped, poured, or otherwise disposed between an interior circumferential surface of the tubular casing 308 and the circumferential surface of the axially-extending heat source 306. The solid tobacco material 310 is, in some aspects, a "dry" tobacco material such that the tobacco material is not associated with an aerosol precursor composition when distributed about the circumferential surface of the axially-extending heat source 306. In other aspects, however, the solid tobacco material 310 is associated with an aerosol precursor composition such as that described about in reference to the smoking article 200.

Still referring to FIG. 3B, a mouthpiece 312 is defined by the second end of the tubular casing 310 and is configured to receive the aerosol from the solid tobacco material 310 in response to a draw applied to the mouthpiece 312. Thus, the tubular casing 310 axially extends from the first end engaged with the second end of the power source 302 about the heat source 306 to the second end defining the mouthpiece 312. The mouthpiece 312 is in some aspects an integral component of the tubular casing 310 and defines an orifice through which the generated aerosol is drawn and received by the user. Otherwise, the mouthpiece 312 is a separate component. As illustrated in FIGS. 3A and 3B, the mouthpiece 312 is provided opposite the cylindrical tube of the solid tobacco material 310 from the power source 302 when the smoking article 300 is provided in an assembled state.

In some still further aspects, a filter material 314 is provided with the smoking article 300. More specifically, for example, the filter material 314 extends at least partially about a circumferential surface of the cylindrical tube of the solid tobacco material 310 and about the second end of the tubular casing 308 within the mouthpiece 312. Due to the insulating properties of the tubular casing 308, the filter material 314 is not subjected to high levels of heat, which is desirable for a pleasurable smoking or smoke-like experience for the user of the smoking article 300. Regardless, in some aspects, the filter material 314 comprises cellulose acetate or another similar material.

The smoking article 300 additionally comprises a control unit 316 in communication with the power source 302. The control unit 316 is housed, in some aspects, within the tubular control enclosure 304. However, the control unit 316 is alternatively housed within the tubular casing 302 or within a separate control enclosure (not shown).

The control unit 316 is configured to perform various functions including for example to actuate the power produced by the power source 302 and to direct the power to the heat source 306. Thus, the control unit 316 is able to thereby regulate the heat produced by the heat source 306. Heating is characterized in relation to the amount of aerosol to be generated. Specifically, the smoking article 300 is configured to provide an amount of heat necessary to generate a defined volume of aerosol (e.g., about 0.5 ml to about 100 ml, or any other volume deemed useful in a smoking article, such as otherwise described herein). In certain instances, the amount of heat generated is measured in relation to a two second puff providing about 35 ml of aerosol at a heater temperature of about 290° C. In some aspects, the article 300 preferably provides about 1 to about 50 Joules of heat per second (J/s), about 2 J/s to about 40 J/s, about 3 J/s to about 35 J/s, or about 5 J/s to about 30 J/s. Otherwise, the amount of heat generated is measured in relation to a total puff provision. In certain instances, the amount of heat generated by the article 300 preferably provides between about 15 puffs to about 20 puffs. Regardless, the aerosol generated is limited to only what is necessary so that excess power is not needlessly expended.

Other functions of the control unit 316 include, for example, controlling power discharge in response to stimuli, controlling and/or monitoring flow of electrical energy, etc. Specifically, in some aspects, the control unit 316 is capable of controlling flow of electrical energy from the power source 302 to other elements of the article 300, such as to the heat source 306. Specifically, in some aspects, the control unit 316 actuates electrical current flow from the power source 302 to the heat source 306. According to some aspects of the present disclosure, the smoking article 300 includes an actuation mechanism such as a pushbutton 318 that is in communication with (e.g., linked to) the control unit 316 and is configured to control actuation of the power produced by the power source 302. In this manner, the pushbutton 318 disposed on the tubular control enclosure 304, or elsewhere, is configured for manual control of electrical current flow, wherein a consumer manipulates the pushbutton 318 to turn on the article 300 and/or to actuate electrical current flow to the power source 302. In some aspects, one or more, two or more, three or more, etc., actuation mechanisms are provided for manual performance of powering the article 300 on and off, and for actuation of the power produced by the power source 302 such as, for example, an electrical current flow from a battery.

Instead of (or in addition to) the pushbutton 318, in some aspects, the smoking article 300 includes one or more control devices (not shown) responsive to the consumer's drawing on the article 300 (i.e., puff-actuated heating). For example, the article 300 includes a switch that is sensitive either to pressure changes or air flow changes as the consumer draws on the article (i.e., a puff-actuated switch). Other suitable current actuation/deactuation mechanisms include, for example, a temperature actuated on/off switch or a lip pressure actuated switch. An exemplary mechanism that provides puff-actuation capability includes a Model 163PC01D36 silicon sensor, manufactured by the Micro-Switch division of Honeywell, Inc., Freeport, Ill. With such a sensor, the heat source 306 is activated rapidly by a change in pressure when the consumer draws on the mouthpiece 318 of the article 300. In addition, flow sensing devices, such as those using hot-wire anemometry principles, are suitable to cause the energizing of the heat source 306 sufficiently rapidly after sensing a change in air flow. A further puff actuated switch that is suitable is a pressure differential switch, such as Model No. MPL-502-V, range A, from Micro Pneumatic Logic, Inc., Ft. Lauderdale, Fla. Another suitable puff actuated mechanism is a sensitive pressure transducer (e.g., equipped with an amplifier or gain stage) which is in turn coupled with a comparator for detecting a predetermined threshold pressure change. Yet another suitable puff actuated mechanism is a vane which is deflected by airflow, the motion of which vane is detected by a movement sensing arrangement. Yet another suitable actuation mechanism is a piezoelectric switch. Also another suitable switch is a suitably connected Honeywell MicroSwitch Microbridge Airflow Sensor, Part No. AWM 2100V from MicroSwitch Division of Honeywell, Inc., Freeport, Ill. Further examples of demand-operated electrical switches that are suitable in a heating circuit according to the present disclosure are described in U.S. Pat. No. 4,735,217 to Gerth et al., which is incorporated herein by reference in its entirety. Other suitable differential switches, analog pressure sensors, flow rate sensors, or the like, will be apparent to the skilled artisan with the knowledge of the present disclosure. A pressure-sensing tube or other passage providing fluid connection between the puff-actuated switch and an air flow passage within the smoking article 300 are suitable so that pressure changes during draw are readily identified by the switch. Further description of current regulating circuits and other control units, including microcontrollers that are suitable in the present smoking article are provided in U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., and U.S. Pat. No. 7,040,314 to Nguyen et al., all of which are incorporated herein by reference in their entireties.

Further, in some instances, capacitive sensing elements are incorporated into the smoking article 300 in a variety of manners to allow for diverse types of "power-up" and/or "power-down" for one or more elements of the smoking article 300. Capacitive sensing includes the use of any sensor incorporating technology based on capacitive coupling including, but not limited to, sensors that detect and/or measure proximity, position or displacement, humidity, fluid level, pressure, or acceleration. Capacitive sensing arises from electronic elements providing for surface capacitance, projected capacitance, mutual capacitance, or self-capacitance. Capacitive sensors generally detect anything that is conductive or has a dielectric constant different than that of air. Capacitive sensors, for example, replace mechanical buttons (i.e., the pushbutton 318 referenced above) with capacitive alternatives. Thus, one specific application of capacitive sensing according to the disclosure is a touch capacitive sensor. For example, a touchable portion (i.e., a touch pad) is present on the smoking article 300 that allows the user to input a variety of commands. Most basically, the touch pad provides for powering the heat source 306 much in the same manner as a pushbutton 318, as already described above. In other aspects, capacitive sensing is applied near the mouthpiece 312 of the smoking article 300 such that the presence and/or pressure of the lips on the smoking article 300 or draw on the article signals the smoking article 300 to provide power to the heat source 306. In addition to touch capacitance sensors, motion capacitance sensors, liquid capacitance sensors, and accelerometers are suitable according to the disclosure to elicit a variety of response from the smoking article 300. Further, photoelectric sensors also are suitable for use in the smoking article 300.

Sensors utilized in the smoking article 300 are configured to expressly signal for power flow to the heat source 306 so as to heat the solid tobacco material 310 and form an aerosol for inhalation by a user. Sensors also provide further functions. For example, a "wake-up" sensor is suitable for inclusion in the smoking article 300. Other sensing methods providing similar function likewise are able to be utilized according to the disclosure.

The control unit 316 further comprises, in some aspects, a current regulating circuit (not shown) that is particularly time based. Specifically, such a circuit includes a mechanism for permitting uninterrupted current flow through the heat source 306 for an initial time period during draw, and a timer device for subsequently regulating current flow until the draw is completed. For example, the subsequent regulation includes the rapid on-off switching of current flow (e.g., on the order of about every 1 to 50 milliseconds) from the power source 302 to maintain the heat source 306 within the desired temperature range. Further, regulation comprises simply allowing uninterrupted current flow until the desired temperature is achieved, and then turning off the current flow completely. The heat source 306 is reactivated by the consumer initiating another puff on the mouthpiece 312 on the article 300 (or manually actuating the pushbutton 318, depending upon the specific switch aspect employed for activating the heat source).

Alternatively, the subsequent regulation involves the modulation of current flow through the heat source 306 to maintain the heat source 306 within a desired temperature range. In some aspects, so as to release the desired amount of the aerosol as described above, the heat source 306 is energized for a duration of about 0.2 second to about 5.0 seconds, about 0.3 second to about 4.5 seconds, about 0.5 second to about 4.0 seconds, about 0.5 second to about 3.5 seconds, or about 0.6 second to about 3.0 seconds. One exemplary time-based current regulating circuit includes a transistor, a timer, a comparator, and a capacitor. Suitable transistors, timers, comparators, and capacitors are commercially available and will be apparent to the skilled artisan. Exemplary timers are those available from NEC Electronics as C-1555C and from General Electric Intersil, Inc. as ICM7555, as well as various other sizes and configurations of so-called "555 Timers". An exemplary comparator is available from National Semiconductor as LM311. Further description of such time-based current regulating circuits and other control units that are useful in the smoking article 300 are provided in U.S. Pat. Nos. 4,922,901, 4,947,874, and 4,947,875, all to Brooks et al., all of which are incorporated herein by reference in their entireties.

The control unit 316 particularly is capable of being configured to closely control the amount of heat provided to the heat source 306 by the power source 302. In some aspects, a current regulating component is capable of stopping current flow to the heat source 306 once a defined temperature has been achieved. Such a defined temperature is in a range that is substantially high enough to aerosolize any solid tobacco material 310 and any further inhalable substances and provide an amount of aerosol equivalent to a typical puff on a conventional cigarette, as otherwise discussed herein. While the heat needed to aerosolize the solid tobacco material 310 in a sufficient volume to provide a desired volume for a single puff is variable, it is particularly useful for the heat source 306 to heat to a temperature of about 120° C. or greater, about 130° C. or greater, about 140° C. or greater, or about 160° C. In some aspects, in order to aerosolize an appropriate amount of the solid tobacco material 310, the heating temperature is about 180° C. or greater, about 200° C. or greater, about 300° C. or greater, or about 350° C. or greater. In additional aspects, the defined temperature for aerosol formation is about 120° C. to about 350° C., about 140° C. to about 300° C., or about 150° C. to about 250° C.

In still further aspects, the control unit 316 including a current regulating component is configured to cycle the current to the heat source 306 from the power source 302 off and on to maintain a first temperature that is below an aerosol forming temperature and then allow an increased current flow so as to achieve a second temperature that is greater than the first temperature and that is an aerosol forming temperature. Such controlling advantageously improves the response time of the article 300 for aerosol formation such that aerosol formation begins almost instantaneously upon initiation of a puff by a consumer. According to some aspects, the first temperature (which is, for example, characterized as a standby temperature) is only slightly less than the aerosol forming temperature defined above. Specifically, for example, the standby temperature is about 50° C. to about 150° C., about 70° C. to about 140° C., about 80° C. to about 120° C., or about 90° C. to about 110° C.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

That which is claimed:

1. A smoking article comprising:

a heat source configured to generate heat upon ignition thereof;

a first substrate material having opposed first and second ends, the first end of the first substrate material being fixedly engaged with the heat source and the first substrate material having an aerosol precursor composition associated therewith;

an aerosol delivery component having opposed first and second ends, the first end of the aerosol delivery component being engaged with the second end of the first substrate material, the aerosol delivery component comprising:

a second substrate material having the aerosol precursor composition associated therewith and being disposed about the first end of the aerosol delivery component;

a mouthpiece having a filter material and being disposed about the second end of the aerosol delivery component; and a tobacco material disposed between the second substrate material and the mouthpiece, the aerosol precursor composition associated with the first and second substrate materials being configured to produce an aerosol in response to the heat generated by the ignited heat source, the aerosol being drawn across the tobacco material and through the filter material of the mouthpiece in response to a draw applied to the mouthpiece.

2. The smoking article of claim 1, wherein the aerosol delivery component comprises a cylindrical housing defining a cavity configured to receive and retain the tobacco material between the second substrate material and the mouthpiece.

3. The smoking article of claim 1, further comprising an outer wrap configured to circumscribe the heat source, the first substrate material engaged about the first end thereof with the heat source, and the aerosol delivery component engaged with the second end of the first substrate material.

4. The smoking article of claim 3, wherein the outer wrap comprises a liner material disposed adjacent to the heat source, the first substrate material, and the aerosol delivery component, the liner material being configured to thermally regulate conduction of the heat generated by the ignited heat source radially outward of the liner material.

5. The smoking article of claim 4, wherein the liner material comprises a material selected from the group consisting of foil, graphene, graphite, and aluminum oxide.

6. The smoking article of claim 1, wherein the first substrate material and the second substrate material comprise cellulose acetate and the aerosol precursor composition comprises glycerin coated on the cellulose acetate.

7. The smoking article of claim 1, wherein the tobacco material comprises tobacco-containing beads, tobacco shreds, tobacco strips, pieces of a reconstituted tobacco material, or combinations thereof.

8. The smoking article of claim 1, wherein the heat source comprises an extruded monolithic carbonaceous material.

9. The smoking article of claim 8, wherein the extruded monolithic carbonaceous material defines one or more channels extending longitudinally from a first end of the extruded monolithic carbonaceous material to an opposing second end of the extruded monolithic carbonaceous material.

* * * * *